US007014067B1

(12) United States Patent
Daru

(10) Patent No.: US 7,014,067 B1
(45) Date of Patent: Mar. 21, 2006

(54) METHOD AND APPARATUS FOR MIXING AND DISPENSING OIL AND GASOLINE IN A TANK

(76) Inventor: Robert Daru, 13663 Walnut St., Southgate, MI (US) 48195

( * ) Notice: Subject to any disclaimer, the term of this patent is extended or adjusted under 35 U.S.C. 154(b) by 345 days.

(21) Appl. No.: 10/613,926

(22) Filed: Jul. 5, 2003

Related U.S. Application Data

(60) Provisional application No. 60/394,203, filed on Jul. 5, 2002.

(51) Int. Cl.
*B65D 88/54* (2006.01)

(52) U.S. Cl. ..... 222/318; 222/1; 222/424

(58) Field of Classification Search ..... 222/1, 222/318, 424
See application file for complete search history.

(56) References Cited

U.S. PATENT DOCUMENTS 2,061,013 A * 11/1936 Wade ..... 222/630
2,191,688 A * 2/1940 Thau ..... 285/280
2,898,002 A * 8/1959 Blanchet ..... 222/26
3,024,806 A * 3/1962 Colonna ..... 137/893
3,335,746 A * 8/1967 Lebow ..... 137/389

* cited by examiner

*Primary Examiner*—J. Casimer Jacyna
(74) *Attorney, Agent, or Firm*—John R. Benefiel

(57) ABSTRACT

An apparatus and method for mixing and dispensing gasoline and oil from a tank in which a flow of gasoline and oil is diverted from a dispenser pump outlet back into the tank to create a mixing of the gasoline and oil to dispensing the mixed gasoline and oil by operation of a dispensing nozzle also connected to the pump outlet.

2 Claims, 1 Drawing Sheet

METHOD AND APPARATUS FOR MIXING AND DISPENSING OIL AND GASOLINE IN A TANK

CROSS REFERENCE TO RELATED APPLICATIONS

This application claims the benefit of U.S. provisional application Ser. No. 60/394,203, filed Jul. 5, 2002.

BACKGROUND OF THE INVENTION

This invention concerns dispensing of gasoline-oil mixtures. Such dispensing is sometimes done from storage tanks moved to job sites such as for landscaping and construction crews to fuel two cycle powered equipment.

Large tanks are filled with gasoline with an appropriate amount of oil added, necessary to lubricate two cycle engines.

It is critical that the oil be thoroughly mixed with the gasoline to insure that the two cycle engines using the fuel will be properly lubricated.

This is difficult when large tanks (i.e., containing fifty to several hundred gallons of fuel) are used to store the gasoline.

It is the object of the present invention to provide a simple but very effective apparatus and method for mixing gasoline and oil in a large tank also used in dispensing the gasoline-oil mixture.

SUMMARY OF THE INVENTION

The above object and others which will become apparent upon a reading of the following specification and claims are achieved by a diversion of the dispensing flow induced by operation of the pump. The flow diversion is controlled by a selectively operated valve which connects the dispensing pump outlet to a fluid conduit extending downwardly into the tank, terminating in a jetting nozzle directing a strong jet flow into the gasoline-oil mixture preferably directed horizontally across the bottom of the tank. This jet flow creates a powerful stirring or mixing action, insuring a thorough mixing of the gasoline and oil within a few minutes.

The diverter valve is then closed to allow dispensing of the mixture via a dispensing nozzle also connected to the pump outlet. The dispensing nozzle has a shut off valve which is closed during the mixing operation.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
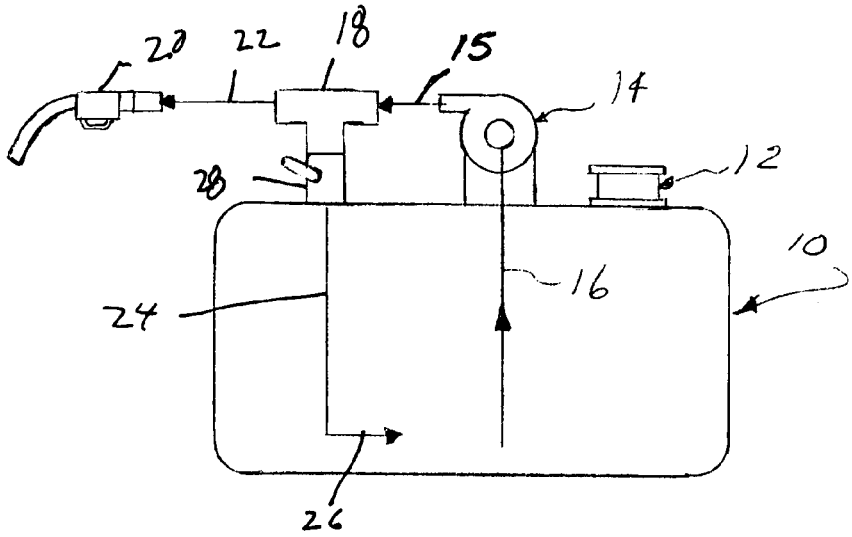
FIG. 1 is a diagram of a fuel storage tank with associated dispensing and mixing components.

Referring to the drawings, FIG. 1 depicts a fuel storage tank 10 of a size holding 275 gallons, although the invention can be applied to tanks of varying capacities from 50–500 or more gallons. Gasoline and two cycle oil are introduced through a suitable capped filler opening 12.

An electrically powered dispensing pump 14 is mounted on the tank 10, with a draw tube 16 extending into the tank interior connected to the pump inlet. An on-off switch (not shown) allows selective operation of the pump 14 for dispensing fuel in a known manner. The outlet of the pump 14 is connected via fluid line 15 to a tee 18 which in turn connects to a dispenser nozzle 20 via a flexible hose 22.

A trigger operated valve included in the dispenser nozzle 20 manually controls outflow of fuel when dispensing.

The tank 10 and pump 14 are normally grounded to avoid electrical arcs, and the hose 22 may have metal conductors embedded therein for the same purpose.

According to the present invention, the tee 18 allows diversion of liquid back into the tank 10 when the dispenser nozzle 20 valve is shut off via a connected down tube 24 which terminates in a smaller diameter tube 26 which directs a strong jet of liquid horizontally across the bottom region of the tank 10. This creates a powerful mixing action of the liquids in the tank 10, which action can be completed in five minutes or so. A ball valve 28 allows the diverted flow to be shut off for normal dispensing of the now thoroughly mixed fuel.

Figure 2:
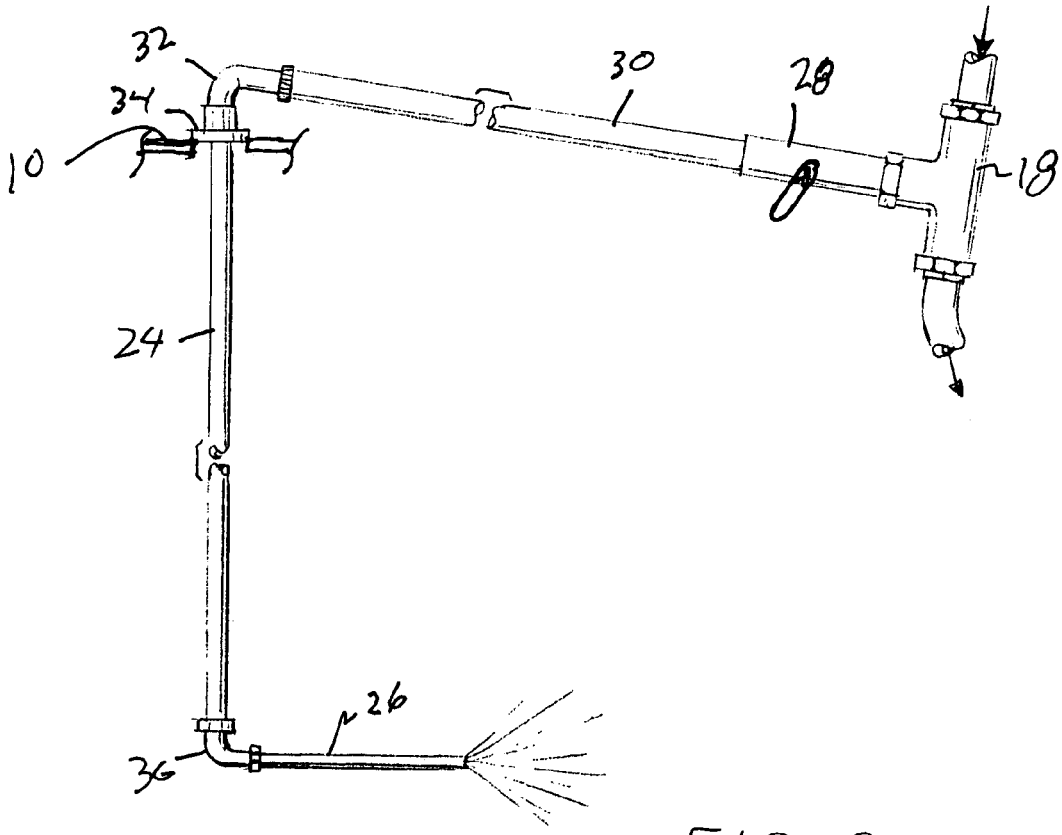
FIG. 2 is an enlarged detailed diagram of the mixing components included in the diagram of FIG. 1.

FIG. 2 shows further details in which a ¾ inch rubber hose 30 connects the tee 18 to a street elbow 32 received in a bushing 34 threaded into a bung hole in the tank 10. The down tube 24 is ¾ inch black pipe extending to the vicinity of the bottom of the tank 10 where a reducing elbow 36 connects to the horizontal ⅜ inch jetting pipe 26. A strong jet or spray results setting up recirculation and thoroughly mixing of the fuel in the tank 10.

The nozzle 20 is shut off at this time to prevent escape of fuel and complete diversion of fuel to the jetting pipe 26.

The valve 28 is then closed, and normal dispensing of the thoroughly mixed fuel via nozzle 20 can then proceed.

What is claimed is:

1. A method of mixing and dispensing gasoline and oil for a two cycle engine, comprising the steps of:

introducing gasoline and oil into a tank;

connecting a pump inlet to a draw tube extending down into said tank to enable pumping said gasoline and oil out of said tank;

connecting a pump outlet to a dispensing nozzle for dispensing said gasoline and oil;

selectively connecting said pump outlet to a pipe extending back into said tank to divert an outflow of liquid from said pump back into said tank, and, forming a jetting outflow of liquid received in said down tube into said tank to create a mixing of gasoline and oil in said tank;

thereafter discontinuing said diverted out flow; and dispensing said mixed gasoline and oil fuel from said nozzle.

2. The method according to claim 1 including the step of directing said jetting outflow across a bottom region of said tank.

* * * * *